US010538951B2

(12) United States Patent
Herrmann et al.

(10) Patent No.: US 10,538,951 B2
(45) Date of Patent: Jan. 21, 2020

(54) DEVICE FOR MOTORICALLY AND MANUALLY ADJUSTING A VEHICLE PART

(71) Applicant: Brose Fahrzeugteile GmbH & Co. KG, Bamberg, Bamberg (DE)

(72) Inventors: Christian Herrmann, Grossheirath (DE); Wolfgang Uebel, Weitramsdorf (DE)

(73) Assignee: BROSE FAHRZEUGTEILE GMBH & CO. KG, BAMBERG, Bamberg (DE)

( * ) Notice: Subject to any disclaimer, the term of this patent is extended or adjusted under 35 U.S.C. 154(b) by 0 days.

(21) Appl. No.: 15/643,288

(22) Filed: Jul. 6, 2017

(65) Prior Publication Data

US 2018/0023330 A1 Jan. 25, 2018

(30) Foreign Application Priority Data

Jul. 22, 2016 (DE) ..... 10 2016 213 525

(51) Int. Cl.
*E05F 15/611* (2015.01)

(52) U.S. Cl.
CPC ..... *E05F 15/611* (2015.01); *E05Y 2900/531* (2013.01)

(58) Field of Classification Search
CPC ..... E05F 15/611; E05F 15/655; E05F 15/70; E05Y 2900/531; E05Y 2800/11; E05Y 2201/216
See application file for complete search history.

(56) References Cited

U.S. PATENT DOCUMENTS

2008/0083168 A1 4/2008 Booth et al.
2010/0253095 A1* 10/2010 Bendel ..... E05B 81/14 292/200

(Continued)

FOREIGN PATENT DOCUMENTS

CN 1512282 A 7/2004
CN 102057123 A 5/2011

(Continued)

OTHER PUBLICATIONS

European Search Report dated Dec. 14, 2017, 7 pages.

(Continued)

*Primary Examiner* — Yuen Wong
(74) *Attorney, Agent, or Firm* — Lewis Roca Rothgerber Christie LLP

(57) ABSTRACT

A device for motorically and manually adjusting a second vehicle part relative to a first vehicle part in an adjustment range is provided. The device comprising at least a driving device by means of which the second vehicle part is motorically adjustable in at least one adjustment direction and can be held in an adjustment position within the adjustment range relative to the first vehicle part, wherein the driving device is switchable between a holding position and a release position and in the holding position the second vehicle part is held in an adjustment position via the driving device and in the release position is manually adjustable within the adjustment range, and an electronic control device by means of which the driving device is switchable between the holding position and the release position in response to an operating event triggered by a user.

12 Claims, 4 Drawing Sheets

(56) References Cited

U.S. PATENT DOCUMENTS

| | | | | |
|---|---|---|---|---|
| 2014/0000167 | A1 | 1/2014 | Patel et al. | |
| 2016/0369551 | A1* | 12/2016 | Suzuki | E05C 17/00 |

FOREIGN PATENT DOCUMENTS

| | | | |
|---|---|---|---|
| CN | 105358785 | A | 2/2016 |
| DE | 102014211138 | | 12/2015 |
| DE | 10 2016 211 777 | A1 | 1/2018 |
| EP | 3 017 984 | A1 | 5/2016 |
| JP | 9-317323 | | 12/1997 |
| JP | 2000-356069 | | 12/2000 |
| JP | 2004-238893 | A | 8/2004 |
| KR | 97-16015 | | 4/1997 |
| KR | 10-2009-0007640 | | 1/2009 |
| WO | WO 2009/147866 | A1 | 12/2009 |
| WO | WO 2018/002157 | A1 | 1/2018 |

OTHER PUBLICATIONS

Korean Office action dated Feb. 27, 2019 issued in corresponding Korean Application No. 10-2017-0091393, 4 pages, with English translation, 3 pages.

CN First Office action dated Oct. 9, 2018 issued in corresponding CN Application No. 201710601012.3, 9 pages, with English translation, 5 pages.

Korean Notice of Allowance dated Aug. 29, 2019 issued in corresponding Korean Patent Application No. 10-2017-0091393, 2 pages, with English translation, 1 page.

* cited by examiner

DEVICE FOR MOTORICALLY AND MANUALLY ADJUSTING A VEHICLE PART

CROSS-REFERENCE TO RELATED APPLICATION

This application claims priority to German Patent Application No. 10 2016 213 525.2 filed on Jul. 22, 2016, the entirety of which is incorporated by reference herein.

BACKGROUND

This invention relates to a device for motorically and manually adjusting a second vehicle part relative to a first vehicle part in an adjustment range and to a method for motorically and manually adjusting a second vehicle part.

A generic device includes at least one driving device by means of which the second vehicle part is motorically adjustable in at least one adjustment direction and can be held in an adjustment position within the adjustment range relative to the first vehicle part. The second vehicle part thus is adjustably mounted relative to the first vehicle part and possibly even on this vehicle part itself, wherein for example an electromotive adjustment of the second vehicle part becomes possible via the driving device. The second vehicle part also is held in an adopted adjustment position within the defined adjustment range via the driving device. For example, the driving device therefor blocks the second vehicle part against an adjustment out of the adjustment position. Such a device for example is known for the adjustment of a vehicle door which is articulated to a vehicle body. The vehicle door can be opened and/or closed motorically by means of a door drive. Holding the vehicle door in a partly or completely open adjustment position here usually is effected steplessly via the driving device.

In particular in devices for adjusting vehicle doors it is necessary to permit a manual adjustment in addition to a power-operated adjustment. In vehicle doors, for example, this frequently is solved such that opening of the vehicle door is effected motorically, but when a user then exerts a sufficiently high force on the vehicle door, this is interpreted as operating event and a manual adjustment of the vehicle door is permitted. The driving device now changes from a holding position, in which the vehicle door is held in an adopted adjustment position, into an release position in which a manual adjustment of the vehicle door is permitted within the adjustment range and the driving device no longer blocks the second vehicle part against an adjustment. A generic device for example is known from DE 10 2014 211 138 A1.

In this connection it is known to provide an electronic control device by means of which the driving device is switchable between the holding position and the release position in response to an operating event triggered by a user. Thus, via such an electronic control device the driving device for example can be switched into a release position, when a user pulls or pushes a partly open vehicle door in direction of a closed position with a force exceeding a threshold value.

The usually abruptly occurring free movability of the vehicle door, however, has turned out to be not much appealing for a user. In addition, the abrupt change into the release position involves particular problems over the service life of the device, as here, in particular due to temperature, actuating noises can occur and/or the difference between the blocking effect of the driving device in the holding position and the free movability of the vehicle door in the release position of the driving device is relatively large and for a user the change is effected at an apparently non-predictable time.

SUMMARY

It therefore is an object of the invention to further improve a device as mentioned above, in particular with regard to the operating comfort and the change between a holding position and a release position of the driving device.

This object is solved both with a device with features as described herein and with a method with features as described herein.

Accordingly, a device according to the invention comprises an electronic control device which is configured to, in response to an operating event triggered by a user, initially actuate the driving device for a power-operated adjustment out of the adjustment position in that adjustment direction in which the manual adjustment is to be made before switching into the release position.

It hence is the idea underlying the invention to initially trigger an adjustment in the desired adjustment direction via the driving device, before the driving device is switched into the release position, after it has been recognized that a manual adjustment is desired on the part of the user. Thus, an adjustment of the second vehicle part initially is made motorically—preferably for a comparatively short period of few seconds or less than one second—, before the driving device switches into the release position and the second vehicle part is freely adjustable in the desired adjustment direction. An abrupt change between the holding position and the release position of the driving device thereby is avoided. The driving device instead is actuated for a transitional adjusting movement, in order to have the transition from the power-operated to the manual adjustment appear less abrupt. When during this transitional adjusting movement a driving force is produced by the driving device for adjusting the second vehicle part, this no longer is the case in the release position. Here, the driving device neither acts against the manual adjustment nor does the driving force support the manual adjusting movement.

A device according to the invention here can be used for the power-operated and manual adjustment of different vehicle parts. In particular, it is expediently applicable for the adjustment of a vehicle door which is adjustably mounted on a vehicle body, in order to clear a door opening. A device according to the invention can, however, also be used for other adjustably mounted vehicle parts, e.g. for a tailgate or luggage compartment flap, a sliding door or an engine hood.

For example, the driving device comprises a switchable and possibly self-locking transmission which in the holding position of the driving device couples a drive motor with a drive element for transmitting an adjusting force and in the release position interrupts this coupling. Alternatively or in addition, a coupling can be part of the driving device, which is closed in the holding position, in order to arrest the second vehicle part in an adjustment position, and which is open in the release position, in order to provide for a manual adjustment of the second vehicle part.

In one exemplary embodiment the electronic control device is coupled with at least one sensor unit by means of which an operating event triggered by a user is electronically detectable, via which it is signaled by the user in what adjustment direction the user wants to manually adjust the second vehicle part.

The at least one sensor unit can be configured to (directly or indirectly) detect a force manually applied onto the second vehicle part, via which the second vehicle part is pushed or pulled by the user from the adjustment position in an adjustment direction. A correspondingly manually applied force for example is (indirectly) detectable within the driving device or is (directly) detectable via a pressure sensor at the vehicle part. When the respective force exceeds a threshold value stored in the control device, this is interpreted as an operating event and the driving device is activated to adjust the second vehicle part, so that the second vehicle part carries out the transitional adjusting movement.

To have the power-operated transitional adjusting movement proceed hardly noticeable for a user, the electronic control device can be configured to initially actuate the driving device for a power-operated adjustment for a period of less than two seconds, before the driving device is switched into the release position and possibly deactivated, in response to an operating event triggered by a user. By a comparatively short power-operated adjustment of the second vehicle part, before the manual adjustment (finally) is permitted, a short fluent transition between the different switching states of the driving device becomes possible. Before a user is able to exclusively manually adjust the second vehicle part, the second vehicle part thus already is motorically adjusted out of the adjustment position in which the second vehicle part has remained at rest due to the driving device.

It was found that even a transitional adjusting movement of less than one second and in particular in a range of 40 ms to 650 ms, e.g. in a range of 50 ms to 300 ms, already leads to a transition between holding position and release position which a user perceives as pleasant and fluent. For example, the control device can be configured to initially actuate the driving device for a power-operated adjustment for a period of about 500 ms in the adjustment direction desired on the part of the user, before switching into the release position, in response to an operating event triggered by a user.

In the electronic control device at least one desired profile curve can be stored for the driving device, wherein via this desired profile curve the course of an adjustment speed of the second vehicle part is specified for the power-operated adjustment before switching into the release position. Consequently, when an operating event for adjusting the second vehicle part out of the adjustment position is recognized, the electronic control device for example controls a power-operated adjustment of the second vehicle part via the at least one desired profile curve such that the second vehicle part is adjusted with an incrementally or continuously rising adjustment speed.

In principle, it can be provided that the desired profile curve proceeds ramp-like in at least one portion. This in particular includes the fact that the desired profile curve has a ramp-like course and—within the specified activation period of for example less than 2 seconds, in particular in a range of 40 ms to 650 ms, e.g. in a range of 50 ms to 300 ms—specifies a continuously rising adjustment speed for the second vehicle part.

In one design variant the electronic control device is configured to actuate the driving device for an adjustment of the second vehicle part out of the adjustment position with different adjustment speeds, wherein the different adjustment speeds depend on a detected vehicle inclination, the adjustment direction, the adjustment position within the adjustment range and/or on an actuating force with which a user acts on the second vehicle part, in order to trigger the operating event. For example, the adjustment speed is varied, namely in dependence on whether or not the vehicle is standing on a slope, the second vehicle part is to be closed or opened, the second vehicle part is present in the region of an end of the defined adjustment range (e.g. a vehicle door already is almost completely closed or open) and/or a user for example acts on the second vehicle part with high force (and hence for example wants to vigorously shut a vehicle door).

In this connection it can also be provided that different desired profile curves for the driving device are stored in the electronic control device to specify different profiles of the adjustment speed, wherein the different desired profile curves are automatically selected by the electronic control device in dependence on the vehicle inclination, the adjustment direction, the adjustment position and/or the height of the actuating force. Information on the individual relevant parameters concerning for example a vehicle inclination, the desired adjustment direction, the current adjustment position of the second vehicle part and/or the height of an actuating force can be provided to the electronic sensor unit via separate sensors of the device and/or via sensors present already on the vehicle. For transmission to the electronic sensor unit of the device a CAN bus can be utilized, for example.

As already explained above, the driving device in one design variant can include a switchable transmission unit and/or a switchable coupling unit, via which

- in the holding position a drive motor of the driving device is coupled with a drive element via which a motoric adjusting force for the power-operated adjustment of the second vehicle part can be transmitted, and
- in the release position a coupling between the drive motor and the driven element is interrupted.

The transmission unit or the coupling unit thus provides for both a preferably electromotive adjustment of the second vehicle part and a manual adjustment. When the vehicle parts are to be motorically adjusted relative to each other, the transmission unit or the coupling unit is brought into a coupling state, so that a coupling between the drive motor and the associated drive element is established, and by driving the drive element the second vehicle part can motorically be adjusted relative to the first vehicle part. When the second vehicle part is to be moved manually, the transmission unit or the coupling unit on the other hand is brought into a freewheeling state, so that the drive element is decoupled from the drive motor. The drive element then can be moved independent of the drive motor, which provides for a manual adjustment of the second vehicle part without the drive motor having to be moved as well. According to the invention it is provided in this connection that in the case of a change from the holding position into the release position and hence from a coupling state to a freewheeling state, with the second vehicle part initially at rest, a power-operated transitional adjusting movement is effected by the drive motor, before a coupling between the drive motor and the drive element is interrupted—and for example a coupling is opened—and the drive motor is stopped.

Subject-matter of the invention furthermore is a method for motorically and manually adjusting a second vehicle part relative to a first vehicle part in a defined adjustment range.

A method according to the invention is based on the same fundamental idea as a device according to the invention and correspondingly provides that

- the second vehicle part is motorically adjustable in at least one adjustment direction by means of a switchable driving device and can be held in an adjustment position within the adjustment range relative to the second vehicle part, wherein the driving device is switchable between a holding position and a release position and in the holding position the second vehicle part is held in an adjustment position via the driving device and in the release position is manually adjustable within the adjustment range, and the driving device is switched from the holding position into the release position in response to an operating event triggered by a user, in order to permit a manual adjustment of the second vehicle part by the user relative to the first vehicle part.

Furthermore, it is provided that in response to the operating event triggered by a user the driving device initially motorically adjusts the second vehicle part from the adjustment position in that adjustment direction in which the manual adjustment is to be made, and the driving device subsequently is switched into the release position. Thus, with the second vehicle part initially at rest, a transitional adjusting movement of the second vehicle part also is effected here, before the driving device changes into the release position and the second vehicle part is freely adjustable.

A method according to the invention can of course be carried out with a device according to the invention. Correspondingly, the advantages and features of design variants of a device according to the invention as explained above and below also apply for variants of a method according to the invention, and vice versa.

Moreover, it should also be noted that an adjustment position within the defined adjustment range also can be understood to be a position of the second vehicle part relative to the first vehicle part, in which the second vehicle part is present in one of two possible end positions of the adjustment range. For example, it can be provided that a maximally open vehicle door initially also is slightly and for a comparatively short period motorically adjusted in closing direction, before the vehicle door is released and a user ultimately purely manually completely closes the vehicle door and therefor pushes or pulls the same (further) in the closing direction.

BRIEF DESCRIPTION OF THE DRAWINGS

The attached Figures by way of example illustrate possible design variants of the invention.

DETAILED DESCRIPTION

Figure 1A:
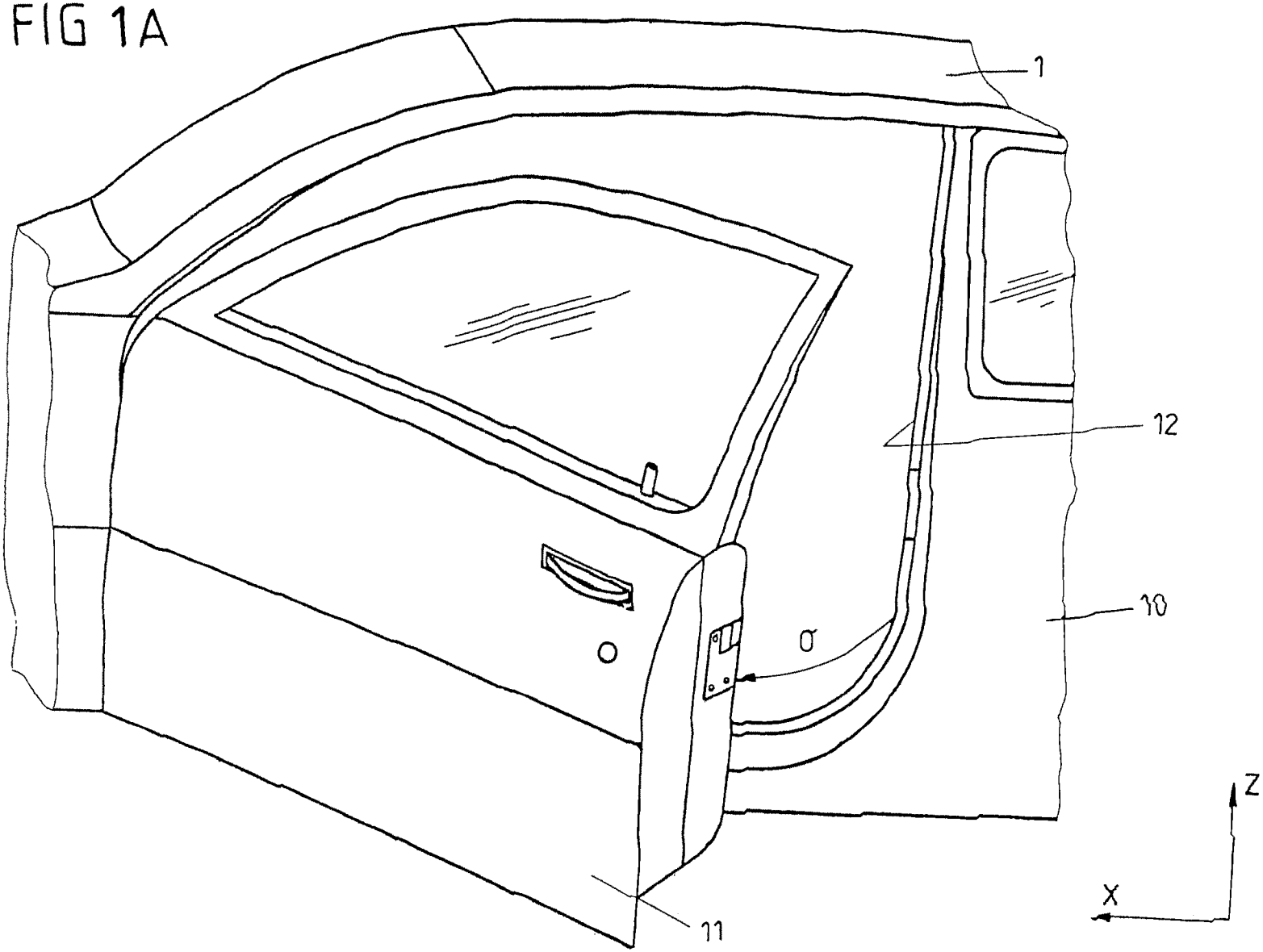
FIG. 1A sectionally and in a perspective view shows a motor vehicle with a vehicle door pivotally mounted on the vehicle body, at which a variant of a device according to the invention is used.

FIG. 1A sectionally shows a (motor) vehicle 1 with a view towards a partly open vehicle door 11. The vehicle door 11 is articulated to a (vehicle) body 10 of the vehicle 1 and in the closed condition closes a door opening 12. Along an opening direction O, the vehicle door 11 can be swung open.

Figure 1B:
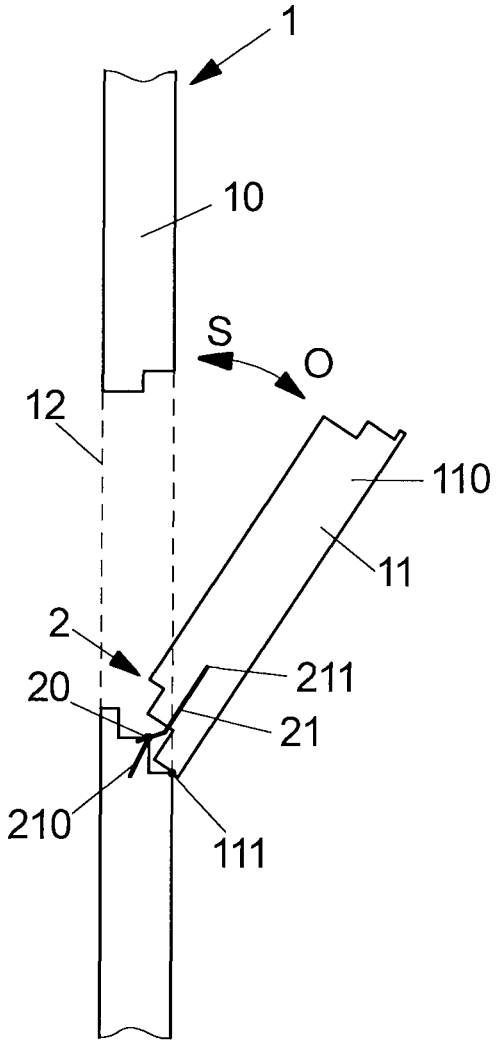
FIG. 1B in a sectional view from above shows the vehicle door of FIG. 1A with a section of the vehicle body and parts of a driving device.

As is shown in the sectional view of FIG. 1B, an apparatus with a driving device 2, which includes an adjustable part 21 in the form of a catch strap and serves for fixing and adjusting the vehicle door 11 relative to the body 10, acts between the body 10 and the vehicle door 11. The adjustable part 21 in the form of the catch strap is articulated to the body 10, for example to the A-pillar of the vehicle 1, about a joint 20 and on pivoting of the vehicle door 11 moves relative to the vehicle door 11. With one end 211 the adjustable part 21 therefor protrudes into a door inner space 110 of the vehicle door 11 and on adjustment of the vehicle door 11 moves into this door inner space 110.

The vehicle door 11 articulated to the body 10 via a door hinge 111 here is motorically adjustable both in opening direction O and, in opposite direction, in a closing direction S, via the apparatus with the driving device in the form of a door drive 2. The door drive 2 here is formed such that the vehicle door 11 thereby is steplessly arrested in an adopted adjustment position between a maximally open and a completely closed position of the vehicle door 11 and consequently the partly or completely open vehicle door 11 is blocked against an adjustment via the door drive 2.

The door drive 2 is not exclusively formed for a power-operated adjustment of the vehicle door 11. Rather, the door drive 2 also provides for a manual adjustment of the vehicle door 11, for example for closing the vehicle door 11 in closing direction S. To this end, the door drive 2 for example includes a transmission unit or a coupling unit, via which a drive motor of the door drive 2, for example an electric motor, is coupled with a drive element which interacts with the adjustable part 21 in the form of the catch strap and via which a motoric adjusting force for adjusting the vehicle door 11 can be transmitted. The door drive 2 here is switchable to interrupt a coupling between the drive motor and the drive element. In a condition coupled in, the door drive 2 is in a holding position in which the at least partly open vehicle door 11 is held in an adopted adjustment position via the door drive 2. In the decoupled condition, the door drive 2 then on the other hand is in a release position in which the vehicle door 2 can freely be manually adjusted in opening direction O or closing direction S and the door drive 2 no longer blocks the vehicle door 11 against such an adjustment. An exemplary apparatus with such door drive 2 is known for example from DE 10 2014 211 138 A1.

With at least partly open vehicle door 11 it is sensorily detected by means of an electronic control device whether a user manually attempts to move the vehicle door 11, for example to close the same again. When a manually applied actuating force at the vehicle door 11 exceeds a stored threshold value, the vehicle door 11 is released by the door drive 2. The door drive 2 changes from the holding position into its release position, for example in that a coupling between drive motor and drive element is interrupted on the transmission side or a coupling is opened.

A change between holding position and release position, however, usually is effected abruptly in practice and hence in a way unexpected for a user. With regard to an operating comfort as high as possible, this possibly is disadvantageous, as a user can perceive the change between holding position and release position as haptically unpleasant and surprising.

Figure 2:
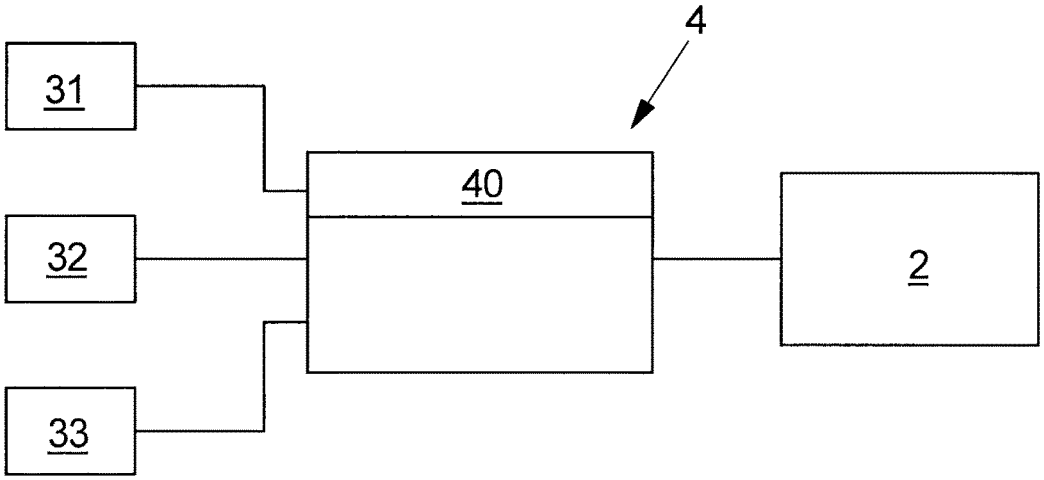
FIG. 2 schematically shows the interaction of different sensor units with an electronic control device for actuating the driving device of FIG. 1B.

To address this problem, one exemplary embodiment of a solution according to the invention provides that an electronic control device 4 corresponding to FIG. 2 is coupled with the door drive 2. Via this control device 4, with the vehicle door 11 at rest or at least partly open, the vehicle door 11 initially is motorically adjusted by means of the door drive 2 in an adjustment direction S or O, in which the user has signaled that he wants to manually adjust the vehicle door 11, in response to an operating event triggered by a user. The door drive 2 will be switched into the release position only thereafter, so that the vehicle door 11 is freely adjustable. Thus, after the electronic detection of an operating event the vehicle door 11 initially is motorically adjusted for a certain and preferably comparatively short time in that adjustment direction S or O in which a user pulls or pushes the vehicle door 11, before the door drive 2 subsequently switches into the release position, which for example includes the fact that a coupling of the door drive 2 is opened and a drive motor of the door drive 2 is stopped.

The vehicle door 11 thus for example is motorically moved in closing direction S for a short time, i.e. for less than 2 seconds, and in particular for a period in the range of 40 ms to 650 ms, when a user pulls or pushes the at least partly open vehicle door 11 in closing direction S. Only after the vehicle door 11 has been moved in closing direction S, will the door drive 2 change into its release position, so that the further adjustment in closing direction S solely can be effected by a manually applied force on the part of the user. Thus, in response to an operating event which signals that the user wishes to adjust the vehicle door 11, a transitional adjusting movement in the desired adjustment direction S or O is carried out motorically, in order to create a less abrupt and more fluent transition between holding position and release position of the door drive 2. Switching into the release position here is effected only after the vehicle door 11 has been put into movement by the door drive 2.

The door drive 2 in principle can be regulated or controlled. Furthermore, at least one desired profile curve can be stored in the electronic control device 4, by which the course of an adjustment speed v of the vehicle doors 11 is specified, when the vehicle door 11 is to be adjusted in response to an operating event, before a manual adjustment is permitted.

As is schematically illustrated with reference to FIG. 2, the control device 4 can be coupled with different sensor devices 31, 32 and 33. A first sensor device 31 for examples serves the detection of the operating event, by which a user signals that a manual adjustment of the at least partly open vehicle door 11 is desired. The first sensor device 31 therefor for example comprises a force sensor and/or an acceleration sensor, as is described for example in DE 10 2016 211 777. Via a second sensor device 32 an inclination of the vehicle 1 can be detected, for example, while it is detected via a third sensor device 33 in how far the vehicle door 11 is opened, i.e. which adjustment position it takes within the permitted adjustment range.

The electronic sensor device 4 now can be configured to actuate the door drive 2 in different ways for a transitional adjusting movement in dependence on a signal or measured value or several signals or measured values of the sensor devices 31, 32 and 33. The control device 4 for example can vary the actuation of the door drive 2 in dependence on the vehicle inclination, the adjustment direction S or O desired on the part of the user, the current adjustment position of the vehicle door 11 and/or the height of the actuating force applied on the part of a user. This variation in particular includes a variation of the duration of the activation of a drive motor of the door drive and/or the variation of a speed of the drive motor.

Thus, a speed profile on adjustment of the vehicle door 11 can be varied via the electronic control device 4 during the transitional adjusting movement in dependence on the vehicle inclination, the adjustment direction S or O, the adjustment position and/or the height of the actuating force. For example, different desired profile curves can also be stored therefor in a memory area 40 of the control device 4, wherein different desired profile curves for example are stored therefor, when

- the vehicle is inclined with respect to the horizontal by more than a certain angle (for example is parked on a slope), for example is inclined by more than 10° or 25°;
- the vehicle door 11 is to be closed or opened further;
- the vehicle door 11 at rest is present in a first or second half of the permitted adjustment range, i.e. is present closer to its closed position or closer to the maximally open position (so that for example in the case of an adjustment in closing direction S a shorter or longer adjustment path must be covered); and
- a user acts on the vehicle door 11 with high force, i.e. a force exceeding a stored threshold value, for example in order to vigorously shut said vehicle door in closing direction S.

Independent of the presence of several desired profile curves or the desired profile curves to be chosen, it is provided in one design variant that via the electronic control device 4 a speed profile rising in a ramp-like manner is specified for the vehicle door 11 to be adjusted from a rest position during the transitional adjusting movement. For the user, this additionally improves the impression of a fluent transition to the free adjustability of the vehicle door 11.

Figure 3:
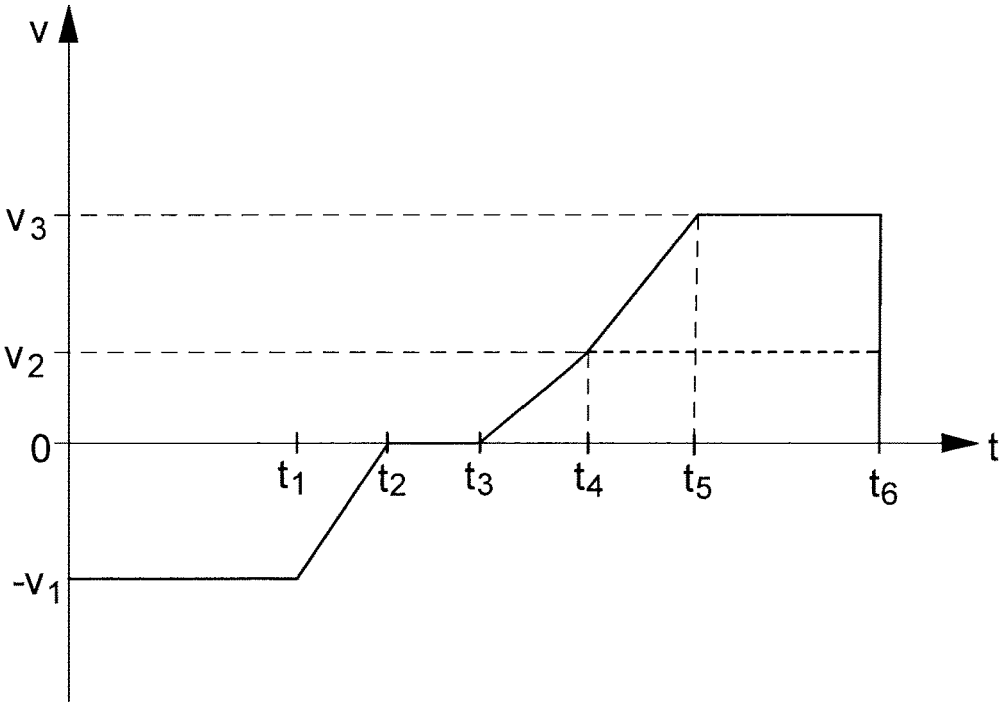
FIG. 3 shows a speed-time diagram to illustrate the mode of operation of an exemplary embodiment of a device according to the invention, which is operated by a method according to the invention.

With reference to the diagram of FIG. 3, the mode of operation of a variant of the solution according to the invention will be illustrated in detail. In the diagram of FIG. 3 an adjustment speed v of the vehicle door 11 is plotted over the time t. A negative adjustment speed $-v_1$ indicates an adjustment of the vehicle door 11 in opening direction O, while a positive adjustment speed v indicates an adjustment of the vehicle door 11 in closing direction S.

Correspondingly, FIG. 3 initially shows how the vehicle door 11 is adjusted with a speed $-v_1$ along the opening direction O. At a time $t_1$ the adjusting movement of the vehicle door 11 is slowed down, so that at a time $t_2$ it comes to rest in a desired adjustment position. In this adopted adjustment position the door drive 2 is in a holding position, so that the vehicle door 11 is fixed in the adopted adjustment position via the door drive 2.

When an operating event triggered by a user now is sensorily, e.g. via the sensor device 31 of FIG. 2, detected at a later time $t_3$, after which the vehicle door 11 is to be closed, the drive motor of the door drive 2 is briefly activated and a transitional adjusting movement is triggered. During this transitional adjusting movement, the vehicle door 11 is accelerated up to an adjustment speed $v_2$ in a comparatively small period $\Delta t = t_4 - t_3$. The period $\Delta t$ is less than one second and for example lies in a range of less than 500 ms, in particular in a range of 50 ms to 300 ms.

At the time $t_4$ the door drive 2 then is switched into the release position, which for example includes the fact that a coupling of the door drive 2 is opened and the drive motor is switched off. Alternatively, it is of course also possible to initially switch off the drive motor and subsequently open a coupling of the door drive 2, or both can be effected at the same time. Subsequent to the time $t_4$ the adjustment in closing direction S then exclusively is effected manually by the user. It can be provided, for example, that the user continues to adjust the vehicle door 11 with approximately the same adjustment speed $v_2$, until the vehicle door 11 is closed completely at the time $t_6$. Another scenario illustrated in FIG. 3 by way of example provides that the user continues to accelerate the vehicle door 11 to an adjustment speed $v_3$ from the time $t_4$ up to a later time $t_5$, and then finally closes the vehicle door 11 approximately with this higher adjustment speed $v_3$.

Figure 4:
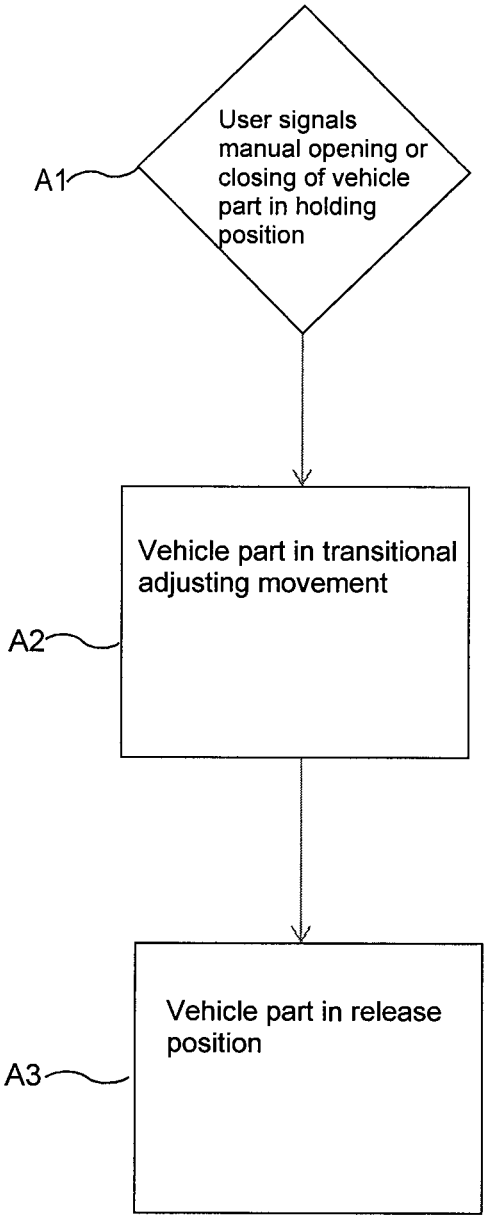
FIG. 4 shows a flow diagram of an exemplary embodiment of a method according to the invention.

With reference to FIG. 4 a possible procedure for the operation of the apparatus including the door drive 2 by way of example is illustrated in detail with reference to a flow diagram.

At a method step A1, the vehicle door 11 initially is immovable in an at least partly open adjustment position in which the door opening 12 is at least partly cleared. When in this phase an operating event is sensorily detected, by which a user signals that he wants to further manually open or again close the vehicle door 11, an actuation of the door drive 2 with a stored desired profile curve is effected in a succeeding method step A2. The vehicle door 11 thereby is motorically put into a transitional adjusting movement in the desired adjustment direction S or O, possibly in dependence on the vehicle inclination and/or the height of an actuating force applied on the part of the user and for a comparatively short period, for example less than 500 ms, in particular for 50 ms to 300 ms.

Upon completion of the transitional adjusting movement, the door drive 2 then is switched into its release position in a method step A3, and in particular a drive motor of the door drive 2 is switched off, so that the vehicle door 11 is freely adjustable by an actuating force applied manually on the part of the user.

LIST OF REFERENCE NUMERALS

1 vehicle
10 body (1st vehicle part)
11 vehicle door (2nd vehicle part)
110 door inner space
111 door hinge
12 door opening
2 door drive (driving device)
20 joint
21 catch strap (adjustable part)
210, 211 end
31, 32, 33 sensor unit
4 control device
40 memory area
O opening direction
S closing direction

The invention claimed is:

1. A device for motorically and manually adjusting a second vehicle part relative to a first vehicle part in an adjustment range, the device comprising:

a driving device configured to motorically adjust the second vehicle part in both a closing direction and an opposite opening direction and configured to hold the second vehicle part in an adjustment position within the adjustment range between a maximally open and fully closed position relative to the first vehicle part, wherein the driving device is switchable between a holding position and a release position such that in the holding position the second vehicle part is held in an adjustment position via the driving device and in the release position the second vehicle part is manually adjustable within the adjustment range, and an electronic control device configured to switch the driving device from the holding position into the release position in response to an operating event triggered by a user in order to permit a manual adjustment of the second vehicle part by the user relative to the first vehicle part, wherein the electronic control device is coupled with at least one sensor unit configured to electronically detect the operating event triggered by the user, via the operating event, the user signals the manual adjustment of the second vehicle part in the closing or the opposite opening direction, and wherein the electronic control device is further configured to, in response to the operating event triggered by the user and before switching into the release position for enabling the manual adjustment of the second vehicle part, initially actuate the driving device for a power-operated adjustment out of the adjustment position in either the closing or opposite opening direction depending on which one of the closing and opposite opening directions the manual adjustment is to be made, thereby creating a transitional adjusting movement of the second vehicle part which is configured to transition into an entirely manual adjustment of the second vehicle part.

2. The device according to claim 1, wherein the at least one sensor unit is configured to detect a force manually applied onto the second vehicle part, via which the second vehicle part is pushed or pulled by the user from the adjustment position in the closing or opposite opening direction.

3. The device according to claim 1, wherein the electronic control device is configured to initially actuate the driving device for the power-operated adjustment for a period of less than 2 seconds in response to an operating event triggered by the user before switching into the release position.

4. The device according to claim 3, wherein the electronic control device is configured to initially actuate the driving device for a period of less than one second.

5. The device according to claim 4, wherein the electronic control device is configured to initially actuate the driving device for a period in a range of 40 ms to 650 ms or 50 ms to 300 ms.

6. The device according to claim 1, wherein at least one desired profile curve is stored in the electronic control device for the driving device, by which the course of an adjustment speed of the second vehicle part is specified during the power-operated adjustment before switching into the release position.

7. The device according to claim 6, wherein the at least one desired profile curve extends in a ramp-like manner in at least one portion.

8. The device according to claim 6, wherein the electronic control device is configured to actuate the driving device to motorically adjust the second vehicle part out of the adjustment position with different adjustment speeds, namely depending on a detected vehicle inclination, the adjustment direction, the adjustment position within the adjustment range, and/or in dependence on an actuating force with which the user acts on the second vehicle part, in order to trigger the operating event, and different desired profile curves for the driving device that are stored in the electronic control device to specify different profiles of the adjustment speed depending on the vehicle inclination, the adjustment direction, the adjustment position and/or a height of the actuating force.

9. The device according to claim 1, wherein the electronic control device is configured to actuate the driving device to motorically adjust the second vehicle part out of the adjustment position with different adjustment speeds, namely in dependence on a detected vehicle inclination, in dependence on the adjustment direction, in dependence on the adjustment position within the adjustment range, and/or in dependence on an actuating force with which the user acts on the second vehicle part in order to trigger the operating event.

10. The device according to claim 1, wherein the driving device includes a switchable transmission unit and/or a switchable coupling unit via which:

a drive motor of the driving device is coupled with a drive element in the holding position, the drive element being configured to transmit a motoric adjusting force for the power-operated adjustment of the second vehicle part, and a coupling between the drive motor and the drive element is interrupted in the release position.

11. A method for motorically and manually adjusting a second vehicle part relative to a first vehicle part in an adjustment range, the method comprising:

motorically adjusting the second vehicle part in both a closing direction and an opposite opening direction by a switchable driving device and holding the second vehicle part in an adjustment position within the adjustment range between a maximally open and a fully closed position relative to the first vehicle part, holding the second vehicle part in an adjustment position via the drive device being in a holding position;

electronically detecting, by at least one sensor unit, an operating event triggered by a user, via which the user signals a manual adjustment of the second vehicle part in the closing or opposite opening direction, in response to the operating event triggered by the user and before switching into a release position for enabling the manual adjustment of the second vehicle part, initially and motorically adjusting the second vehicle part via the driving device from the adjustment position in either the closing or opposite opening direction depending on which one of the closing and opposite opening directions the manual adjustment is to be made thereby creating a transitional adjusting movement of the second vehicle part which is configured to transition into an entirely manual adjustment of the second vehicle part, and then switching the driving device from the holding position into the release position in which the second vehicle part is manually adjustable within the adjustment range in order to permit the entirely manual adjustment of the second vehicle part by the user relative to the first vehicle part.

12. A device for motorically and manually adjusting a second vehicle part relative to a first vehicle part in an adjustment range, the device comprising:

a driving device configured to motorically adjust the second vehicle part in an adjustment direction and configured to hold the second vehicle part in an adjustment position within the adjustment range relative to the first vehicle part, wherein the driving device is switchable between a holding position and a release position such that in the holding position the second vehicle part is held in an adjustment position via the driving device and in the release position the second vehicle part is manually adjustable within the adjustment range, and an electronic control device configured to switch the driving device from the holding position into the release position in response to an operating event triggered by a user, in order to permit a manual adjustment of the second vehicle part by the user relative to the first vehicle part, wherein the electronic control device is further configured to, in response to the operating event triggered by the user, initially actuate the driving device for a period of than 2 seconds for a power-operated adjustment out of the adjustment position in the adjustment direction in which the manual adjustment is to be made before switching into the release position.

* * * * *